US005150504A

United States Patent [19]

Cohen

[11] Patent Number: 5,150,504

[45] Date of Patent: Sep. 29, 1992

[54] UNIVERSAL TETHER APPARATUS

[75] Inventor: Carl M. Cohen, Evanston, Ill.

[73] Assignee: Sassy, Inc., Northbrook, Ill.

[21] Appl. No.: 696,352

[22] Filed: May 6, 1991

[51] Int. Cl.[5] ..... A44B 21/00

[52] U.S. Cl. ..... 24/302; 24/3 M

[58] Field of Search ..... 24/301, 302, 3 M, 3 R, 24/3 C, 442, 306, 597; 224/194, 252; 606/234, 235, 236, 91

[56] References Cited

U.S. PATENT DOCUMENTS

| | | | |
|---|---|---|---|
| D. 276,939 | 12/1984 | Pascoe | D24/46 |
| D. 295,558 | 5/1988 | Jefferson et al. | D24/34 |
| D. 310,716 | 9/1990 | Trask | D24/34 |
| 296,022 | 4/1884 | Langerfeld | 24/3 M |
| 1,093,927 | 4/1914 | Haas, Jr. | 24/597 |
| 1,609,347 | 12/1926 | Dee | 224/252 |
| 1,887,491 | 11/1932 | Johnson | 24/3 M |
| 3,392,729 | 7/1968 | Lenoir | 128/360 |
| 4,700,408 | 10/1987 | Winger | 2/49 R |
| 4,718.586 | 1/1988 | Hagino | 224/252 |
| 4,765,037 | 8/1988 | Perry | 24/301 |
| 4,901.406 | 2/1990 | Shelby et al. | 224/252 |
| 4,903,698 | 2/1990 | Huber et al. | 606/235 |
| 4,972,980 | 11/1990 | Parsons | 224/194 |
| 4,985,968 | 1/1991 | Hooper | 24/302 |
| 4,990,157 | 2/1991 | Roberts et al. | 606/234 |
| 4,994,075 | 2/1991 | Smith et al. | 606/235 |

*Primary Examiner*—Victor N. Sakran
*Attorney, Agent, or Firm*—Dick and Harris

[57] ABSTRACT

A universal tether apparatus for releasably attaching juvenile articles, such as pacifiers, teething devices, rattles and toys, to the clothing of an infant. The apparatus includes releasably affixable attachment members capable of alternatively coupling to and releasing from, both male post-type and female loop-type elements of juvenile articles. A flexible strap attached to a post attachment end and a second attachemnt member facilitates universal securement of either end of the strap to an apparatus body, or to a juvenile article—depending on whether the juvenile article has a post-type or loop-type grasping/attachment element. The apparatus body includes a connection attachment region for operable secured acceptance of the post attachment end of the flexible strap when the second attachment end is alternatively secured to the juvenile article, as well as an alternative receiving member for attachment of the second attachment member of the flexible strap—when the post attachment end is itself alternatively secured to the juvenile article. A biased clip facilitates releasable securement of the apparatus body to the infant's clothing.

20 Claims, 1 Drawing Sheet 120
20
25
125
100
101

5
46
45
27
42
23
6
47
29
38
40
7
33
41
37

42
23
39
40
28
53
50
55
41
35
29
52
37
58

23
42
33
27
46
45
125
47

47
23

66
65
72
73
25
70
72
74

23
20
28
66
35
50
65
25
70
101
100

23
66
35
50
29
65
25

50
35
23
47

50
35
23

25
65
66
106
107
105

50
55
35
29
58
70
25
65
66
108
105
106

UNIVERSAL TETHER APPARATUS

BACKGROUND OF THE INVENTION

The present invention relates in general to juvenile article securement devices, and, in particular, to a universal tether apparatus for releasably attaching juvenile articles to the clothing of an infant. These types of articles releasably restrain pacifiers, teething devices, rattle and toys, while the present invention is capable of restraining juvenile articles of the type having either a male post-type grasping/attachment element, and/or a female loop-type grasping/attachment element.

For many years, various means have been used to secure, or attach, juvenile articles to the clothing of an infant, so as to prevent the infant from losing the article, as well as to avoid the need for a parent or guardian to constantly "keep an eye" on the article which the infant is using, so that it does not become lost, forgotten, or non-hygienic. Three examples of such prior art securement devices are shown in Smith, U.S. Pat. No. 4,994,075; Hooper, U.S. Pat. No. 4,985,968; and Huber, U.S. Pat. No. 4,903,698—all of which disclose a flexible strap member which has one end releasably connected to a juvenile article, such as a pacifier, with another end of the strap being attached to a clip member which is to be secured to an infant's clothing. In Hooper, '968, the clip member comprises two separate and distinct pieces which require the first piece to be placed against the inside surface of the garment it is to be secured to, and a second piece which is to be positioned in aligned relationship with the first piece, on the outside surface of the garment. Once properly aligned, the two pieces are snapped together for securement therebetween. The strap is attached to the exposed, second piece of the clip member.

Although such prior art devices, such as that of Smith, Hooper, and/or Huber, address the securement of a "specific type" of juvenile article, such as those articles having loop-type grasping/attachment elements, or alternatively address securement of different types of articles through adjustable tether elements, they do not facilitate alternative attachment of the first end of the strap, or alternatively, the second end of the flexible strap to standardly shaped juvenile articles having either a loop-type or post-type grasping/attachment element, in secured alternative cooperation with a single clip attachment body.

It is thus an object of the present invention to provide a universal tether apparatus which facilitates interchangeability of either end of the flexible securement strap for operable cooperation with juvenile articles having either standardized loop-type or post-type grasping/attachment elements, while also facilitating interchangeability of the end of the strap not being used for attachment to the juvenile article for secured releasable attachment to the apparatus body.

It is also an object of the present invention to provide a universal tether apparatus which includes a clip member/attachment body constructed from, and comprising, a single piece of material.

It is still further an object of the present invention to provide a universal tether apparatus which is easy to use and comfortable for an infant to where, and, which maintains the juvenile article in a usable, hygienic condition—while being substantially safe for the child's use, through avoidance of overly elastic "snap back" or dangerous piece-part "pin" constructions.

It is yet an additional object of the present invention to provide a universal tether apparatus which is relatively easy to use and deploy, as well as relatively inexpensive to produce.

These and other objects of the present invention will become apparent in light of the present specification and drawings.

SUMMARY OF THE INVENTION

The present invention comprises a universal tether apparatus for releasably attaching juvenile articles such as pacifiers, teething devices, rattles and toys, to the clothing of an infant, through releasable attachment means which are capable of alternatively restraining male post-type, and female loop-type, elements of juvenile articles. The universal tether apparatus has an apparatus body which has a front side and a back side which is opposite the front side, as well as a peripheral edge. The apparatus body additionally includes attachment means which are used to removably attach the apparatus body means to a portion of clothing which is worn by an infant. Flexible connection means which are operably deployed and secured between the apparatus body means and the juvenile articles, have a first end and a second end which are opposite the first end.

Receiving means are operably positioned on the apparatus body means for facilitating releasable affixation of at least one of the first and second ends of the flexible connection means to the receiving means. The receiving means include post means which have a top end and a bottom end positioned opposite to the top end, wherein the top end projects outwardly from the apparatus body means. The top end and the bottom end of the post means form therebetween a connection attachment region which is used for operable cooperation with at least one of the first and second ends of the flexible connection means.

At least the first end of the flexible connection means includes post attachment means which are used for releasable affixation about the connection attachment region of the post means of the apparatus body means, and which are, alternatively, releasably affixable to the male post-type element of the juvenile articles. The second end of the flexible connection means includes second attachment means for releasable affixation to the receiving means which are operably positioned on the apparatus body means, and, alternatively, which are releasably affixable to the female loop-type element of the juvenile articles. In addition, it is preferred that the receiving means which are operably positioned on the apparatus body means, further comprise slot means. The slot means are attached to a portion of the apparatus body means, and may be used to facilitate releasable affixation of the second end of the flexible connection means through and about the slot means. In addition, the slot means further serve as a "secondary lock," which will preclude inadvertent release of the flexible connection means from the apparatus body when the post attachment means is operably attached to the post means of the apparatus body means, and, when second end of the flexible connection means has been threaded through the slot means prior to its attachment to a juvenile article.

In the preferred embodiment of the invention, the post attachment means of at least the first end of the flexible connection means comprises a ring-like member for releasable snap-fit affixation to and around the male post-type element of the juvenile articles. This ring-like member may be constructed from an elastomeric annular ring which has a shape substantially capable of affixation about the shape of the connection attachment region of the post means of the apparatus body means. Furthermore, the second attachment means preferably comprises two or more patches of a hook and loop fastener material (commonly marketed under the Trademark "VELCRO" for releasable looped affixation through and about the slot means, and, alternatively through and about the female loop-type element of the juvenile articles. Although such hook and loop type fastener material is preferred, other types of fastening means, such as snaps, are also contemplated.

Also in the preferred embodiment of the invention, the post attachment means, which is located at the first end of the flexible connection means, may be releasably affixable to the male post-type element of the juvenile articles. Additionally, the second attachment means, which are located at the second end of the flexible connection means, may be releasably secured through and about the slot means of the apparatus body means. Furthermore, it is also contemplated that the flexible connection means which is used to secure the juvenile articles to the apparatus body means, may comprise a flexible textile strap.

In the preferred embodiment of the invention, at least a portion of the flexible connection means is operably positioned through the slot means, which are operably attached to a portion of the apparatus body means, when the first end of the flexible connection means is releasably affixed to the receiving means of the apparatus body means, and, alternatively, to the male post-type element of the juvenile articles. Additionally, the second end of the flexible connection means is releasably affixed to the female loop-type element of the juvenile articles, and, alternatively, to the receiving means of the apparatus body means.

The post attachment means which are located at the first end of the flexible connection means preferably comprises a ring-like member for releasable snap-fit affixation to and about the connection attachment region of the post means, and, alternatively to and about the post-type element of the juvenile articles. It is contemplated that this ring-like member comprises an elastomeric annular material. Furthermore, the post attachment means may additionally be releasably affixable to the post means of the apparatus body means, and the second attachment means of the flexible connection means may be releasably affixable to the female loop-type element of the juvenile articles.

In the preferred embodiment of the invention, the attachment means of the apparatus body means comprises biased clip means which are positioned in substantially planar relationship with the first and second sides of the attachment body means when the attachment body means is in an attached orientation, for facilitating ease in slideable attachment of the apparatus body means to the clothing worn by an infant. The biased clip means has a first end which is secured to the apparatus body means and a free second end which is positioned opposite to the first secured end.

The biased clip means additionally includes grasping means which are integrally attached to, and proximate, the second end of the biased clip means for precluding the inadverdent release of the apparatus body means from the clothing worn by an infant. The grasping means may comprise a hook-like member which serves to releasably snag the clothing worn by an infant. Clip depression means may also be integrally attached to the biased clip means for facilitating flex to the biased clip means, and accordingly thereby facilitating the manual attachment and removal of the apparatus body means to and from the clothing worn by an infant.

In the preferred embodiment of the invention, the post means, which is attached to the apparatus body means, has a substantially C-shaped construction. This C-shaped post means has an interior region which is defined by an inner peripheral surface. Accordingly, the first end of the biased clip means actually depends from the interior region of this C-shaped construction adjacent its inner peripheral surface, and, the free second end of the biased clip means extends beyond the interior region of the C-shaped post means so as to enable an ideal amount of flex to the biased clip means when desired.

DETAILED DESCRIPTION OF THE DRAWINGS

Figures 1, 2, 3, 4, 5, 6, 7, 8, 9, 10, 11, 12:
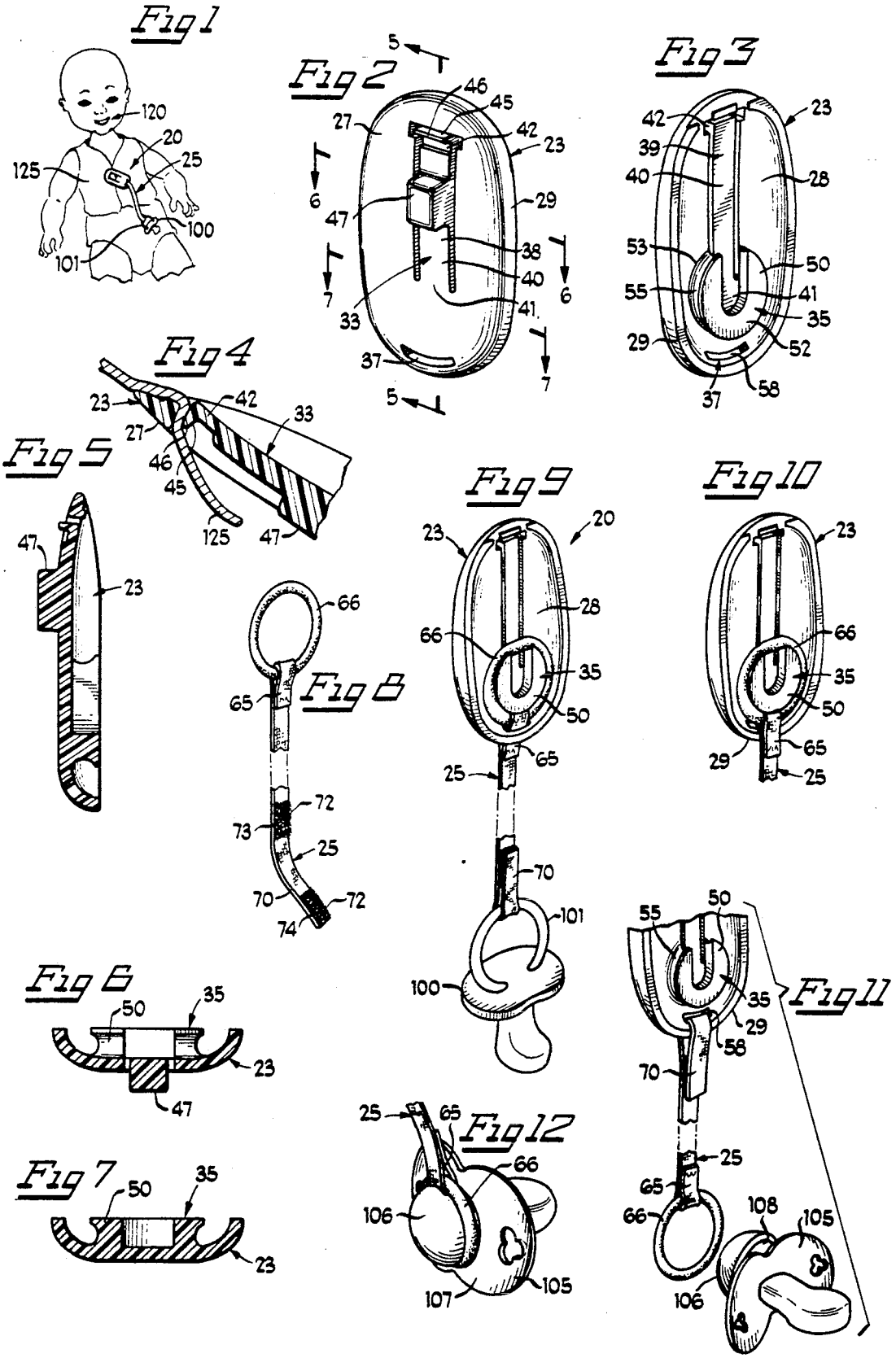
FIG. 1 of the drawings is a front view of the universal tether apparatus, as shown in its intended environment, and, showing in particular, secured positioning of the apparatus body means to the clothing worn by an infant for tethering of a pacifier.
FIG. 2 of the drawings is a front perspective view of the apparatus body means, showing in particular the biased clip means, grasping means and the clip depression means of the attachment means, in its relaxed planar relationship with the front side of the apparatus body means.
FIG. 3 of the drawings is a back perspective view of the apparatus body means, showing in particular the substantially planar relationship of the back side of the biased clip means with respect to the back side of the apparatus body means, as well as the substantially C-shaped configuration of the post means and the operable positioning of the slot means partially positioned therethrough.
FIG. 4 of the drawings is a cross-sectional view of a portion of the universal tether apparatus as attached to the clothing worn by an infant, showing, in particular, the crimping effect of the clip relative to the clothing together with snagging by the hook-like grasping means.
FIG. 5 of the drawings is an elevated cross-sectional side view of the apparatus body means shown in FIG. 2, taken along lines 5—5 and looking in the direction of the arrows, showing the substantially planar positioning of the front and back sides of the attachment means relative to the front and back sides of the apparatus body means when the attachment means is in its relaxed, unattached position.
FIG. 6 of the drawings is a cross-sectional view of the apparatus body means shown in FIG. 2, taken along lines 6—6 and looking in the direction of the arrows.
FIG. 7 the drawings is a cross-sectional view of the apparatus body means shown in FIG. 2, taken along lines 7—7 and looking in the direction of the arrows.
FIG. 8 of the drawings is a perspective view of the flexible connection means, showing the ring-like post attachment means at the first end of the flexible connection means, and the second attachment means at the second end of the flexible connection means.
FIG. 9 of the drawings is a rear perspective view of the universal tether apparatus, showing in particular, attachment of the ring-like post attachment means to the post means of the apparatus body means, and securement of a pacifier's female loop-type (grasping/attachment) element by the second attachment means together with use of the slotted aperture for further securement to the apparatus body.
FIG. 10 of the drawings is a partial cut-away perspective view of a portion of the present universal tether apparatus showing, in particular, the positioning of the flexible connection means over the bottom peripheral edge of the apparatus body means, without utilization of the slot means, while the post attachment ring is releasably affixed to the apparatus body post.
FIG. 11 of the drawings is a partial cut-away perspective view of the universal tether apparatus, showing alternative attachment of the second end of the flexible connection means to the apparatus body through the slotted receiving means with the post type attachment means positioned immediately prior to its attachment to the male post-type element of a juvenile article.
FIG. 12 of the drawings is a perspective view of the flexible connection means, showing operable attachment of the post attachment means to the male post-type element of a juvenile article—here comprising a standardized post-type pacifier.

While this invention is susceptible of embodiment in many different forms, there is shown in the drawings and will herein be described in detail, one specific embodiment with the understanding that the present disclosure is to be considered as an exemplification of the principles of the invention and is not intended to limit the invention to the embodiments illustrated. Universal tether apparatus 20 is shown in FIGS. 1 through 3, and 9 as comprising apparatus body means 23 (having front side 27, back side 28 and peripheral edge 29), apparatus attachment means 33, tether receiving means 35 and 37, each of which are attached to apparatus body means 23, and flexible connection means 25. Apparatus attachment means 33 comprises biased clip 40, grasping means 45 and clip depression means 47. Biased clip means 40, includes first end 41 which is operably attached to apparatus body means 23, second end 42, front side 38 and back side 39. As shown in FIG. 5, when biased clip 40 is in a rested unattached position, front side 38 and back side 39 will be operably positioned in substantially planar relationship with front side 27 and back side 28, respectively, of apparatus body means 23. Grasping means 45 which is located at second end 42 of biased clip means 40 and which projects rearwardly from front side 27 of apparatus body means 23 when clipped onto an infant's clothing, additionally includes hook-like member 46—which is used to secure, crimp and/or snag, the clothing worn by the infant. Clip depression means 47, comprises a clip button which is used to facilitate the flexing of biased clip means 40 during its depression and attachment to the clothing 125 worn by infant 120. Depression means 47 is positioned on biased clip means 40 adjacent front side 27 of apparatus body means 23 (as shown in FIGS. 1 and 2) for easy access by a user's finger.

Receiving means 35, as shown in FIG. 3, includes substantially C-shaped post means 50, which has a top end 52 and a bottom end 53 defining a connection attachment region 55. Post means 50 may operably accept post attachment means 66 of flexible connection means 25, as shown in FIG. 9, for securement therebetween. Although post means 50 is shown to have a C-shaped configuration, other configurations, such as a substantially circular or substantially hexagonal configuration, are also contemplated. Secondary receiving means 37 is operably attached near peripheral edge 29 of apparatus body means 23, (as shown in FIGS. 2 and 3) and comprises slot means 58 which is used to accept either the second attachment means at the second end of flexible connection means 25, or a portion of the connection means adjacent post attachment means 66 as explained hereinbelow relative to FIGS. 9 and 11. Although other types of constructions and materials are contemplated, it is preferred that apparatus body means 23, attachment means 33 and receiving means 35 all be constructed from a single integrated piece such as plastic (e.g. nylon), wood or metal.

Flexible connection means 25, is shown in detail in FIGS. 8, 9 and 11, as including first end 65 having post attachment means 66 secured thereto, and second end 70, which has second attachment means 72 integrated thereat. Post attachment means 66 is removably securable to post means 50, or alternatively, to the equivalently-sized male post-type element of a juvenile article 105 (as shown in FIG. 12). Conversely, second attachment means 72 is removably securable to the female loop-type element 101 of a juvenile article 100 (FIG. 9), or alternatively, to apparatus body 23 through releasable affixation about receiving means slot 58 (FIG. 11). Although it is preferred that post attachment means 66 be constructed from an elastomeric material having an annular ring-like configuration, other materials and configurations are also contemplated. In addition, while it is also preferred that second attachment means 72 comprise mating patches 73, 74 of hook and loop fasteners, such as those commonly marketed under the trademark VELCRO, other types of attaching means, such as snaps, etc., are likewise contemplated.

In operation, releasable securement of apparatus body means 23 to clothing article 125 worn by infant 120, as shown in FIG. 1, is accomplished by manually depressing clip depression means 47 of biased clip 40, as shown in FIG. 2, downwardly so as to force front side 38 and the entirety of hook-like member 46 of grasping means 45, below peripheral edge 29 of back side 28 of apparatus body means 23. Once properly depressed, apparatus body means 23 is then slid over a portion of clothing 125 so that front side 27 of apparatus body means 23 is substantially exposed to view while clip means 33 will be positioned adjacent the inside surface of the clothing 125. Accordingly, releasing the manual pressure exerted upon clip depression means 47 will cause biased clip 40 to spring back towards its rested position so as to cause the adjacent portion of clothing 125 to be sandwiched, crimped or snagged, between clip 40 as well as hook-like member 46 of grasping means 45, and back side 28 of apparatus body means 23, as shown in FIG. 4. It is this crimping and snagging action which precludes the inadverdent release of apparatus body means 23 from the article of clothing 125, until clip depression means 47 may be manually repressed to assist in the release and removal of body 23 from clothing 125. Furthermore, inasmuch as top end 52 of post means 50 is in substantial co-planar relationship with bottom peripheral edge 29 of apparatus body means 23 (as shown in FIGS. 6 and 7), there will not be any protruding surfaces which could otherwise cause irritation to the infant during use.

Securement of a juvenile article, such as juvenile articles 100 and 105, to universal tether device 20, is shown in detail in FIGS. 9 through 12. Although universal tether apparatus 20 is intended for use with many various types of juvenile articles, for ease in illustration, only the releasable attachment of pacifiers, such as pacifiers 100 and 105, will be explained. Pacifiers 100 and 105 each represent two common, commercially available styles of pacifiers. The first type of pacifier 100, includes a female loop-type grasping/attachment element 101, while the second type of pacifier 105, includes a male post-type grasping/attachment element 106. As shown in FIG. 9, when attachment of pacifier 100 is desired for securement to universal tether device 20, attachment is simply accomplished by attaching ring-like member, post attachment means 66 of flexible connection means 25 to apparatus body means 23, and more specifically, over and around connection attachment region 55 of post means 50; and, attaching second attachment means 72 (FIG. 8) at second end 70 of flexible connection means 25, to loop-type grasping/attachment element 101 of pacifier 100. Inasmuch as ring-like member 66 is preferably constructed from an elastomeric material, securement to post means 50 will be accommodated by stretching and releasing the ring over and around top 52 of post means 50—thus causing the ring to snap into region 55. Prior to attachment of flexible connection means 25 to pacifier 100, second end 70 of flexible connection means is threaded through slot means 58 of apparatus body means 23 and pulled therethrough. Second end 70 may then be pulled through female loop-type grasping/attachment element 101 of pacifier 100 until one of the patches 74 of second attachment means 72 passes therethrough. Patch 74 is then manually folded over a portion of female loop-type element 101, and pressed into contact with second patch 73, as shown in FIG. 8, for releasable securement therebetween. While VELCRO brand-type hook and loop fastener patches may be used, snaps may alternatively be utilized. Additionally, although it is preferred that second end 70 of flexible connection means 25 be threaded through slot means 58, non-threaded passage of the tether over slot means 58 is also contemplated, as shown in FIG. 10—though use of slot 58 serves to lock ring 66 into body 23, even if ring 66 slips off post 50.

When attachment of a second type of pacifier 105 is alternatively desired for securement to universal tether device 20, such attachment is accomplished by simply reversing the procedure as explained with respect to attachment of the first type of pacifier 100, then attaching second attachment means 72 of flexible connection means 25 to slot means 58 of apparatus body means 23; and, attaching ring-like member 66 to male post-like grasping/attachment element 106 of pacifier 105, as shown in FIGS. 11 and 12. Attachment of second attachment means 72 to slot means 58 is accomplished by threading second end 70 of flexible connection means 25 through slot means until one of the patches 74 of second attachment means 72 passes therethrough. Patch 74 is then manually folded over and past a portion of peripheral edge 29 of apparatus body means 23, and then pressed into contact with aligned second patch 73, as shown in FIG. 8, for releasable securement therebetween. Once again, while VELCRO patches are shown, other means of attachment such as snaps or clips may be utilized. Prior to, or after attachment of second attachment means 72 to apparatus body means 23, ring-like member 66 is operably secured to post-like member 106 of pacifier 105, by stretching ring-like member 66 thereover post 106. Inasmuch as many pacifiers, such as pacifiers 105, have post-like members 106 which have a grooved portion 108 adjacent the front surface 107 of the pacifier, as shown in FIG. 12, ring-like member 66 can be securely seated around the groove much like the seating of a conventional O-ring. Accordingly, when properly seated, ring-like member 66 will be sandwiched between post member 106 and front surface 107 of pacifier 105, also as shown in FIG. 12.

The foregoing description and drawings merely explain and illustrate the invention and the invention is not limited thereto except insofar as the appended claims are so limited, as those skilled in the art who have the disclosure before them will be able to make modifications and variations therein without departing from the scope of the invention. For example, the present invention contemplates elimination of slot 58, through reliance upon releasable attachment of second attachment means 25 about post means 50 of apparatus body 23.

What is claimed is:

1. A universal tether apparatus for releasably attaching juvenile articles such as pacifiers, teething devices, rattles and toys, to the clothing worn by an infant, through releasable attachment means capable of alternatively restraining male post-type, and female loop-type, elements of said juvenile articles, said universal tether apparatus comprising:

apparatus body means having a front side, a back opposite said front side, and a peripheral edge, said apparatus body means including said attachment means for removably attaching said apparatus body means to said clothing worn by an infant;

flexible connection means having a first end and a second end opposite said first end for operable deployment and securement between said apparatus body means and said juvenile articles; and receiving means operably positioned on said apparatus body means for facilitating releasable affixation of at least one of said first and second ends of said flexible connection means to said receiving means, said receiving means including post means having a top end and a bottom end opposite said top end wherein said top end projects outwardly from said apparatus body means, said top end and said bottom end forming therebetween a connection attachment region for alternatively restrainably affixing and releasing from affixation said at least one of said first and second ends of said flexible connection means, at least said first end of said flexible connection means including post attachment means for said releasable affixation about the connection attachment region of said post means of said apparatus body means and, alternatively, releasably affixable to said male post-type element of said juvenile articles, said second end of said flexible connection means including second attachment means for releasable affixation to said receiving means operably positioned on said apparatus body means and, alternatively, releasably affixable to said female loop-type element of said juvenile articles.

2. The invention according to claim 1 in which said receiving means operably positioned on said apparatus body means further comprises slot means operably attached to a portion of said apparatus body means for facilitating said releasable affixation of said second end of said flexible connection means through and about said slot means.

3. The invention according to claim 1 in which said attachment means of said apparatus body means comprises biased clip means positioned in substantially planar relationship with said first and second sides of said attachment body means when said attachment body means is in an unnattached orientation, for facilitating ease in slideable attachment of said apparatus body means to said clothing worn by an infant, said biased clip means having a first end secured to said apparatus body means and a free second end opposite said first secured end.

4. The invention according to claim 3 in which said biased clip means further includes grasping means integrally attached to and proximate said free second end of said biased clip means for precluding the inadvertent release of said apparatus body means from said clothing worn by an infant.

5. The invention according to claim 4 in which said grasping means of said biased clip means comprises a hook-like member for releasably snagging said clothing worn by an infant.

6. The invention according to claim 5 in which said biased clip means further includes clip depression means integrally attached to said biased clip means for facilitating flex to said biased clip means so as to facilitate the manual attachment and removal of said apparatus body means to and from said clothing worn by an infant.

7. A universal tether apparatus for releasably attaching juvenile articles such as pacifiers, teething devices, rattles and toys, to the clothing worn by an infant, through releasably attachment means capable of alternatively restraining male post-type, and female loop-type, elements of said juvenile article, said universal tether apparatus comprising:

apparatus body means having a front side, a back side opposite said front side, and a peripheral edge, said apparatus body means including said attachment means for removably attaching said apparatus body means to said clothing worn by an infant;

flexible connection means having a first end and a second end opposite said first end for operable deployment and securement between said apparatus body means and said juvenile articles; and receiving means operably positioned on said apparatus body means for facilitating releasably affixation of at least one of said first and second ends of said flexible connection means to said receiving means, said receiving means including post means having a top end and a bottom end opposite said top end wherein said top end projects outwardly from said apparatus body means, said top end and said bottom end forming therebetween a connection attachment region for operable cooperation with said at least one of said first and second ends of said flexible connection means, at least said first end of said flexible connection means including post attachment means for said releasable affixation about the connection attachment region of said post means of said apparatus body means and, alternatively, releasably affixable to said male post-type element of said juvenile articles, said second end of said flexible connection means including second attachment means for releasable affixation to said receiving means operably positioned on said apparatus body means and, alternatively, releasably affixable to said female loop-type element of said juvenile articles;

said receiving means operably positioned on said apparatus body means further comprising slot means operably attached to a portion of said apparatus body means for facilitating said releasable affixation of said second end of said flexible connection means through and about said slot means;

said post attachment means of said at least said first end of said flexible connection means comprising a ring-like member for releasably snap-fit affixation to and around said male post-type element of said juvenile articles.

8. The invention according to claim 7 in which said ring-like member comprises an elastomeric annular ring having a shape substantially capable of affixation about the shape of said connection attachment region of said post means of said apparatus body means.

9. The invention according to claim 8 in which said second attachment means comprises two or more patches of hook and loop fastener material for releasable looped affixation through and about said slot means, and, alternatively through and about said female loop-type element of said juvenile article.

10. The invention according to claim 9 in which:

said post attachment means at said first end of said flexible connection means is releasably affixable to said male post-type element of said juvenile articles, and said second attachment means at said second end of said flexible connection means is releasably secured through and about said slot means of said apparatus body means.

11. The invention according to claim 10 in which said flexible connection means comprises a flexible textile strap.

12. A universal tether apparatus for releasably attaching juvenile articles such as pacifiers, teething devices, rattles and toys, to the clothing worn by an infant, through releasably attachment means capable of alternatively restraining male post-type, and female loop-type, elements of said juvenile articles, said universal tether apparatus comprising:

apparatus body means having a front side, a back side opposite said front side, and a peripheral edge, said apparatus body means including said attachment means for removably attaching said apparatus body means to said clothing worn by an infant;

flexible connection means having a first end and a second end opposite said first end for operable deployment and securement between said apparatus body means and said juvenile articles; and receiving means operably positioned on said apparatus body means for facilitating releasably affixation of at least one of said first and second ends of said flexible connection means to said receiving means, said receiving means including post means having a top end and a bottom end opposite said top end wherein said top end projects outwardly from said apparatus body means, said top end and said bottom end forming therebetween a connection attachment region for operable cooperation with said at least one of said first and second ends of said flexible connection means, at least said first end of said flexible connection means including post attachment means for said releasably affixation about the connection attachment region of said post means of said apparatus body means and, alternatively, releasably affixable to said male post-type element of said juvenile articles, said second end of said flexible connection means including second attachment means for releasable affixation to said receiving means operably positioned on said apparatus body means and, alternatively, releasably affixable to said female loop-type element of said juvenile articles;

said receiving means operably positioned on said apparatus body means further comprising slot means operably attached to a portion of said apparatus body means for facilitating said releasable affixation of said second end of said flexible connection means through and about said slot means;

at least a portion of said flexible connection means being operably positioned through said slot means operably attached to a portion of said apparatus body means, when said post attachment means at said first end of said flexible connection means is releasably affixed to said post means of said apparatus body means, and, said second end of said flexible connection means is releasably affixed to said female loop-type element of said juvenile articles, said flexible connection means within said slot means precluding the release of said post attachment means from said apparatus body means in the event of inadvertent release of said post attachment means from said post means.

13. A universal tether apparatus for releasably attaching juvenile articles such as pacifiers, teething devices, rattles and toys, to the clothing worn by an infant, through releasable attachment means capable of alternatively restraining male post-type, and female loop-type, elements of said juvenile articles, said universal tether apparatus comprising:

apparatus body means having a front side, a back side opposite said front side, and a peripheral edge, said apparatus body means including said attachment means for removably attaching said apparatus body means to said clothing worn by an infant;

flexible connection means having a first end and a second end opposite said first end for operable deployment and securement between said apparatus body means and said juvenile articles; and receiving means operably positioned on said apparatus body means for facilitating releasably affixation of at least one of said first and second ends of said flexible connection means to said receiving means, said receiving means including post means having a top end and a bottom end opposite said top end wherein said top end projects outwardly from said apparatus body means, said top end and said bottom end forming therebetween a connection attachment region for operable cooperation with said at least one of said first and second ends of said flexible connection means, at least said first end of said flexible connection means including post attachment means for said releasable affixation about the connection attachment region of said post means of said apparatus body means and, alternatively, releasably affixable to said male post-type element of said juvenile articles, said second end of said flexible connection means including second attachment means for releasable affixation to said receiving means operably positioned on said apparatus body means and, alternatively, releasably affixable to said female loop-type element of said juvenile articles;

said post attachment means at said first end of said flexible connection means comprising a ring-like member for releasable snap-fit affixation to and about said connection attachment region of said post means, and, alternatively to and about said male post-type element of said juvenile articles.

14. The invention according to claim 13, in which said ring-like member comprises an elastomeric annular material.

15. The invention according to claim 13 in which:

said post attachment means at said first end of said flexible connection means is releasably affixable to said post means of said apparatus body means, and said second attachment means at said second end of said flexible connection means is releasably affixable to said female loop-type element of said juvenile articles.

16. The invention according to claim 15 in which said second attachment means at said second end of said flexible connection means comprises two or more patches of hook and loop fastener material for releasable looped affixation through and about said female loop-type element of said juvenile article.

17. The invention according to claim 13 in which said flexible connection means comprises a flexible textile strap.

18. The invention according to claim 13 in which said post means is of a substantially C-shaped construction.

19. A universal tether apparatus for releasably attaching juvenile articles such as pacifiers, teething devices, rattles and toys, to the clothing worn by an infant, through releasable attachment means capable of alternatively restraining male post-type, and female loop-type, elements of said juvenile articles, said universal tether apparatus comprising:

apparatus body means having a front side, a back side opposite said front side, and a peripheral edge, said apparatus body means including said attachment means for removably attaching said apparatus body means to said clothing worn by an infant;

flexible connection means having a first end and a second end opposite said first end for operable deployment and securement between said apparatus body means and said juvenile articles; and receiving means operably positioned on said apparatus body means for facilitating releasable affixation of at least one of said first and second ends of said flexible connection means to said receiving means, said receiving means including post means having a top end and a bottom end opposite said top end wherein said top end projects outwardly from said apparatus body means, said top end and said bottom end forming therebetween a connection attachment region for operable cooperation with said at least one of said first and second ends of said flexible connection means, at least said first end of said flexible connection means including post attachment means for said releasable affixation about the connection attachment region of said post means of said apparatus body means and, alternatively, releasably affixable to said male pst-type element of said juvenile articles, said second end of said flexible connection means including second attachment means for releasable affixation to said receiving means operably positioned on said apparatus body means and, alternatively, releasably affixable to said female loop-type element of said juvenile articles, said attachment means of said apparatus body means comprising biased clip means positioned in substantially planar relationship with said first and second sides of said attachment body means when said attachment body means is in an unattached orientation, for facilitating ease in slideable attachment of said apparatus body means to said clothing worn by an infant, said biased clip means having a first end secured to said apparatus body means and a free second end opposite said first secured end, said biased clip means further including grasping means integrally attached to and proximate said free second end of said biased clip means for precluding the inadvertent release of said apparatus body means from said clothing worn by an infant, said grasping means of said biased clip means comprising a hook-like member for releasably snagging said clothing worn by an infant, said biased clip means further including clip depression means integrally attached to said biased clip means for facilitating flex to said biased clip means so as to facilitate the manual attachment and removal of said apparatus body means to and from said clothing worn by an infant, said post means being of a substantially C-shaped construction having an interior region defined by an inner peripheral surface, said first end of said biased clip means depending from said interior region of said substantially C-shaped post means adjacent said inner peripheral surface, with said free second end of said biased clip means extending beyond said interior region of said substantially C-shaped post means for facilitating and increasing the length and flex of said biased clip means.

20. The invention according to claim 1 in which said flexible connection means comprises a flexible textile strap.

* * * * *

UNITED STATES PATENT AND TRADEMARK OFFICE

CERTIFICATE OF CORRECTION

PATENT NO. : 5,150,504

DATED : September 29, 1992

INVENTOR(S) : Cohen, Carl M.

It is certified that error appears in the above-identified patent and that said Letters Patent is hereby corrected as shown below:

| | |
|---|---|
| Title Page [57] ABSTRACT, line 8 | "attachemnt" should be instead -- attachment -- |
| Col. 4, line 58 | After "FIG. 7" insert -- of -- |
| Col. 5, line 34 | "Universal" should begin as a new paragraph |
| Col. 9, line 48 | "releasably" should be instead -- releasable -- |
| Col. 10, line 11 | "releasably" should be instead -- releasable -- |
| Col. 10, line 40 | "releasably" should be instead -- releasable -- |
| Col. 10, line 54 | "releasably" should be instead -- releasable -- |
| Col. 10, line 66 | "releasably" should be instead -- releasable -- |

UNITED STATES PATENT AND TRADEMARK OFFICE

CERTIFICATE OF CORRECTION

PATENT NO. : 5,150,504

DATED : September 29, 1992

INVENTOR(S) : Cohen, Carl M.

It is certified that error appears in the above-identified patent and that said Letters Patent is hereby corrected as shown below:

| | |
|---|---|
| Col. 11, line 46 | "releasably" should be instead -- releasable -- |
| Col. 12, line 62 | "pst-type" should be instead -- post-type -- |

Signed and Sealed this

Nineteenth Day of October, 1993

*Attest:*

Bruce Lehman

BRUCE LEHMAN

*Attesting Officer*

*Commissioner of Patents and Trademarks*